US005375337A

United States Patent [19]

Butler

[11] Patent Number: 5,375,337

[45] Date of Patent: Dec. 27, 1994

[54] HAND GUN SIGHTING DEVICE

[75] Inventor: Terry L. Butler, Neosho, Mo.

[73] Assignee: Lohman Mfg. Co., Inc., Neosho, Mo.

[21] Appl. No.: 986,612

[22] Filed: Dec. 7, 1992

[51] Int. Cl.[5] ..... F41A 23/16

[52] U.S. Cl. ..... 33/506; 42/94

[58] Field of Search ..... 33/233, 234, 261, 262, 33/506; 89/37.01, 44.01, 44.02; 42/94, 90, 99; 269/220

[56] References Cited

U.S. PATENT DOCUMENTS

| | | | |
|---|---|---|---|
| 2,740,530 | 4/1956 | Ponder | 89/37.04 |
| 2,877,689 | 3/1959 | Pribis | 89/37.04 |
| 4,207,699 | 6/1980 | Hensley | 42/94 |
| 4,563,829 | 1/1986 | Bozick | 42/94 |
| 4,799,324 | 1/1989 | Nodo | 42/94 |
| 4,819,359 | 4/1989 | Bassett | 42/94 |
| 4,858,359 | 8/1989 | Danz | 42/94 |
| 4,971,208 | 11/1990 | Reinfried, Jr. et al. | 42/94 |
| 5,070,636 | 12/1991 | Mueller | 42/94 |
| 5,081,783 | 1/1992 | Jarvis | 42/94 |
| 5,180,874 | 1/1993 | Troncoso, Jr. | 42/94 |

*Primary Examiner*—Thomas B. Will
*Attorney, Agent, or Firm*—Kokjer, Kircher, Bowman & Johnson

[57] ABSTRACT

A device for assisting in the adjustment of sights for a hand gun including a base elongated in the direction of the axis of the barrel of the gun. The forward end of the base includes a pair of lateral spaced support legs, and the rear of the base includes a single vertically adjustable support leg. Adjacent the forward end is a spacer block having a bolt hole extending laterally therethrough. A clamping jaw is located adjacent each lateral side of the spacer block, with the clamping jaws having resilient foam or similar material on their inner faces. These inner faces are adapted to abut against the lateral sides of the frame of the hand gun to retain it in position and absorb recoil when the gun is fired. To move the clamping jaws into a clamping engagement with the hand gun, there is provided a bolt extending through the hole in the spacer blocks and the associated clamping jaws, with a manually operable nut threaded upon the bolt to provide a clamping force. A resilient pad is located between the clamping jaws and the rear of the base for supporting the butt of the gun and absorbing recoil. An adapter is provided for use with guns having moving frames, and includes a bridging element mounted between the jaws to act as a support for the frame of the gun.

10 Claims, 2 Drawing Sheets

4.
4.
3.
3.
19
24
20a
25
74
20
70
48
48
68
28
26
76
40
22
10
16
18
14
74
20
12
56
68
58
52
44
50
48
42
26a
18
44
54
36
26
30c
30d
30
32
30b
30a

HAND GUN SIGHTING DEVICE

BACKGROUND OF THE INVENTION

1. Field of the Invention

The present invention relates in general to firearms and sights for such firearms. In particular, the present invention relates to an improved device for aiding in the adjustment of sights on a hand gun.

2. Description of the Related Art

It has long been known to provide hand guns with sighting elements to aid in aiming of the weapon. While adjustment of such sights to the proper positions has always been a problem, the advent of highly accurate sighting systems such as telescopic sights and laser sights has increased the need for proper adjustment.

To assist in the adjustment of sights various devices have been proposed, such as shown in U.S. Pat. Nos. 125,743, 2,729,975 and 4,621,563. However, these devices are typically directed toward long guns such as rifles, and suffer from various drawbacks, such as a lack of access to the butt end of the gun which prevents a natural firing position, lack of sufficient recoil absorption, etc. An improvement over these devices is shown in U.S. Pat. No. 4,841,839. The device disclosed in this patent includes a relatively heavy base provided with an adjustable leg at the rear thereof to allow for change in firing angle. Mounted upon the base are a pair of elongated clamping members having resilient inner faces adapted to abut against the sides of the stock of the long gun to clamp the gun therein. This arrangement allows full access to the butt and trigger of the gun such that it may be fired in a natural position, and additionally provides excellent recoil absorption. However, the elongated clamping members do not readily conform to variation in thickness of the stock in the direction of the barrel axis, nor are they suited for use with hand guns.

SUMMARY OF THE INVENTION

An object of the present invention is to provide a device which facilitates adjustment of the sights of a hand gun.

Another object of the present invention is to provide such a device which will readily absorb the recoil when the gun is fired.

Yet another object of the present invention is to provide such a device which may readily be adapted for use with hand guns which do or do not have frames or slides which move during firing of the gun.

A further object of the present invention is to provide a V-block adapter for use with such a device which will allow its use with hand guns which have frames which undergo motion during the firing sequence.

These and other objects are achieved by a device for assisting in the adjustment of sights for a hand gun which includes a base elongated in the direction of the axis of the barrel of the gun. The forward end of the base includes a pair of laterally spaced support legs, and the rear of the base includes a single vertically adjustable support leg. Adjacent the forward end is a spacer block having a bolt hole extending laterally therethrough. A clamping jaw is located adjacent each lateral side of the spacer block, with the clamping jaws having resilient foam or similar material on their inner faces. These inner faces are adapted to abut against the lateral sides of the frame or barrel of the hand gun to retain it in position and absorb recoil when the gun is fired. To move the clamping jaws into a clamping engagement with the hand gun, there is provided a bolt extending through the hole in the spacer blocks and the associated clamping jaws, with a manually operable nut threaded upon the bolt to provide a clamping force. A resilient pad is located between the clamping jaws and the rear of the base for supporting the butt of the gun and absorbing recoil. A V-block adapter is provided for use with guns having moving frames or slides, and includes a bridging support and centering element mounted between the jaws to act as a support for the frame of the gun.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figures 1, 2:
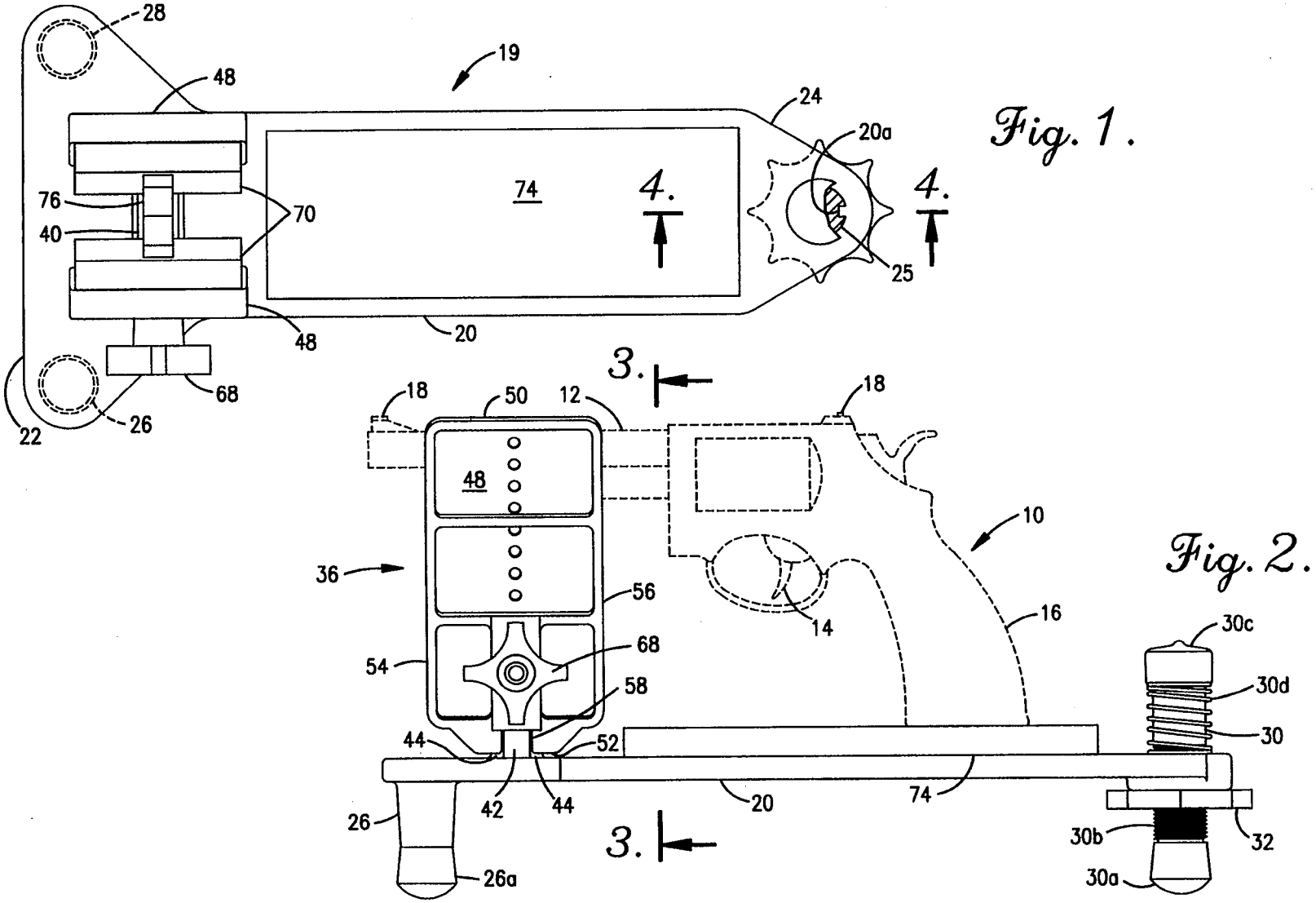
FIG. 1 is a plan view of a device according to the present invention.
FIG. 2 is a left side view of the device of FIG. 1.

With reference to FIG. 2, there is shown a hand gun, generally designated by reference numeral 10. The hand gun may be a revolver, semi-automatic pistol or other such firearm. The gun 10 includes a frame/barrel 12, trigger 14, butt 16 and a sight 18, as are known in the art.

The gun 10 is intended to be mounted within a device according to the present invention, generally designated by reference numeral 19 in FIG. 1. The device 19 includes a base 20 which is elongated in the direction of the axis of the barrel gun 10, hereafter the longitudinal direction. The front end 22 of the base 20 (that end closest to the exit of the barrel of the gun) is widened in the lateral direction and mounts downward extending legs 26 and 28, with one leg being adjacent each of its lateral extremes. The legs 26 and 28 may each be provided with rubber tips **26*a* and 28*a*** with the rubber tips providing friction to reduce slippage of the device, as better described below.

Figure 4:
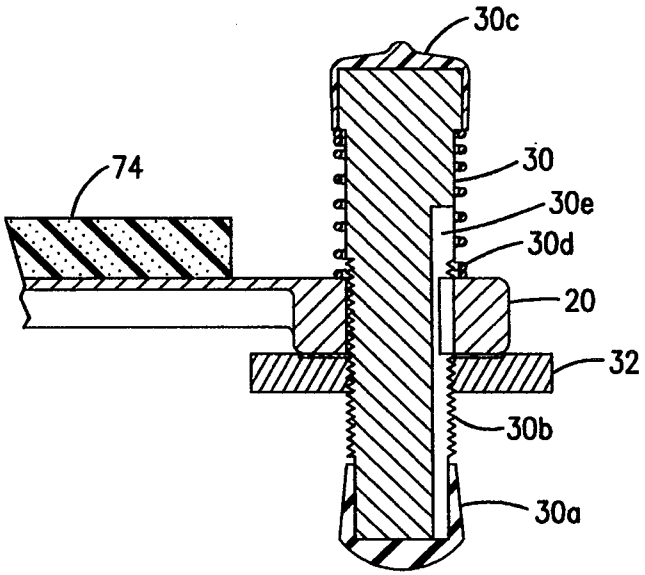
FIG. 4 is a detail view in cross section taken along line 4—4 of FIG. 1.

A third leg 30 is mounted adjacent a rear end 24 of the base 20. In particular, the rear leg 30 is formed as a rod which passes through a hole 25 in the rear end 24. As with the legs 26 and 28, the leg 30 includes a rubber tip **30*a* at its lower end, but additionally includes threads 30b at least in the lower portion of the leg 30. The leg 30 is loosely received within the hole 25 in the base, and additionally includes a slot 30*e* (FIG. 4) extending parallel to its longitudinal axis which receives a mating pin 20*a* projecting into the hole 25 and fixed to the base 20. This pin and groove arrangement prevents rotation of the leg 30 with respect to the base 20**.

A star wheel 32 having internal threads is mated upon the leg 30 at a position intermediate the rubber tip **30*a* and the base 20, such that the presence of the star wheel prevents movement of the base downward with respect to the leg 30. As may be envisioned, rotation of the star wheel 32 will cause it to move longitudinally of the leg 30, thus effectively changing the height of leg 30 with respect to the base 20. This will provide a gross height adjustment which will cause a pivoting motion about the legs 26 and 28, thus varying the angle of exit of a bullet from a gun mounted within the device 19. An appropriate low friction washer may be located intermediate the star wheel 32 and the base 20 to allow smooth rotation of the star wheel. To prevent the leg 30 from falling downward out of the hole in the base, there is provided a top cap 30*c* having a diameter greater than that of the hole in the base, and a resilient spring 30*d* surrounding the leg 30 intermediate the top cap 30*c* and the base 20. The spring 30*d* will thus bias the star wheel 32 into engagement with the base 20**.

The device 19 additionally includes means for supporting the gun thereon. In particular, there is provided means 36 for clamping the gun to the base.

The clamping means 36 includes a spacer block 40 extending vertically upward from the base 20 at a laterally central location. The spacer block 40 has a generally rectangular configuration in a horizontal plane, and has a lateral extent slightly less than the smallest anticipated width of frame/barrel 12 of the gun 10. The spacer block 40 is rigidly mounted to the base 20, and is preferably formed as a monolithic portion thereof. The spacer block includes a land 42 extending laterally outward from its lateral edges. The lands 42 have a lateral dimension less than that of the spacer block 40, and are longitudinally centrally Located with respect to the associated spacer block, such that lateral abutment faces 44 (best shown in FIG. 2) are defined on the lateral sides of the spacer block forward and rear of the land 42. The land 42 additionally has a vertical extent less than that of spacer block 40, and there is formed a through-hole 46 extending laterally through the spacer block 40 at a position vertically above the upper edge of the lands 42.

Figure 3:
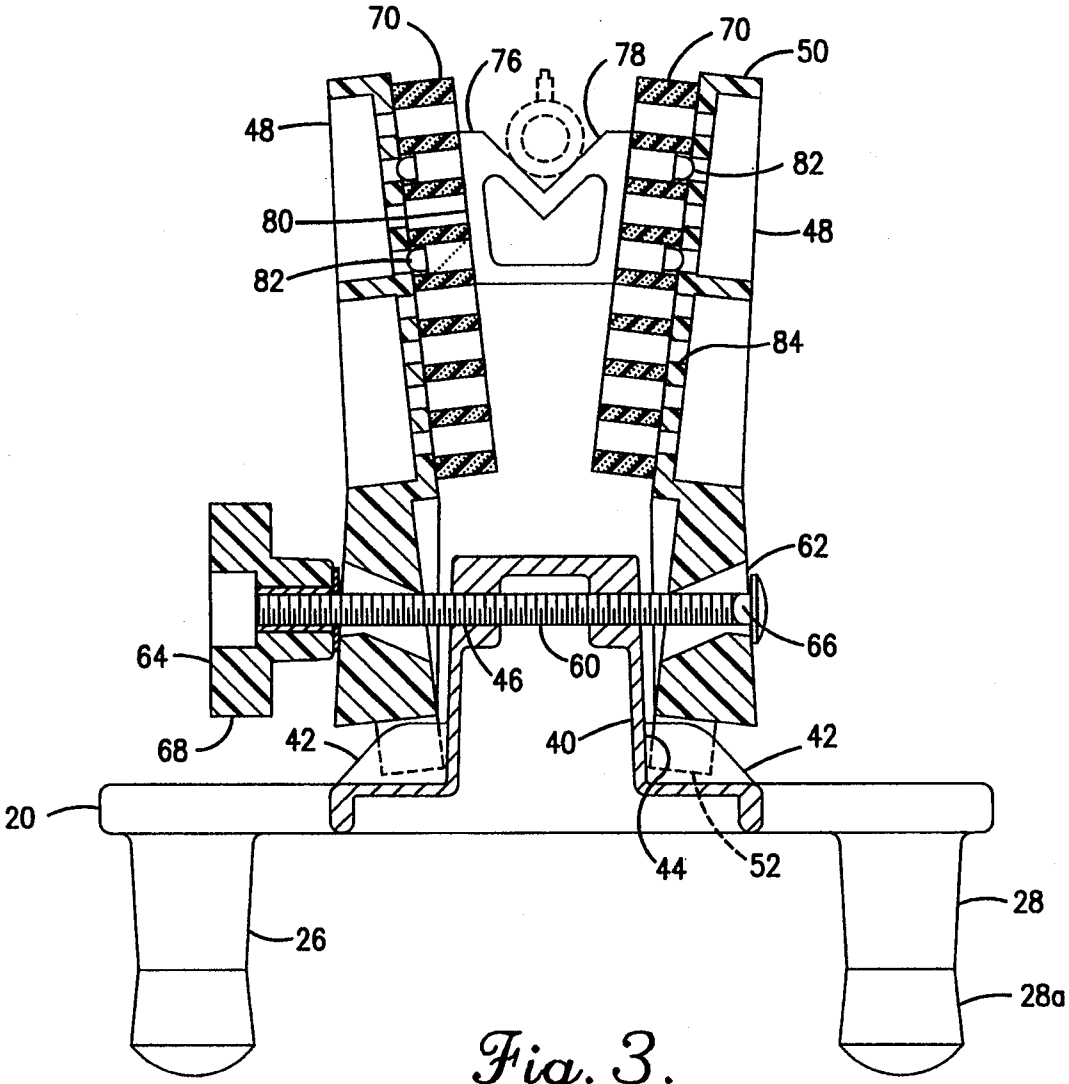
FIG. 3 is a cross sectional view taken along line 3—3 of FIG. 2.

Mounted to the spacer block 40 are a pair of laterally apposed clamping jaws 48. Each of the clamping jaws is substantially identical and is arranged in a mirror image relationship with the other of the clamping jaws about a vertical plane in the longitudinal direction, as is best shown in FIG. 3. Each of the clamping jaws is substantially rectangular and includes a top edge 50 extending vertically above the spacer block 40, a lower edge 52 in proximity to the base 20, and front and rear edges 54 and 56, respectively.

The clamping jaws 48 include a vertical slot 58 extending upwardly, and opening into, the lower edge 52, with the slot 58 being sized to loosely receive the land 42. By this arrangement the upper end of the slot 58 will prevent downward movement of the clamping jaw 48 by abutment against the land 42, while the receipt of the land 42 within the slot 58 will prevent longitudinal movement of the clamping jaw 48, although it is preferred that there is sufficient clearance to allow the jaw 48 to pivot slightly about a vertical axis extending through the land 42. As is best shown in FIG. 3, the lower edge 52 of the jaw 48 may abut against the vertical abutment faces 44 when in the operative position. As the lateral width of the spacer block 40 is less than the smallest anticipated width of the frame/barrel 12, only this lower edge 52 of the clamping jaw will be in contact with the spacer block 40 when the frame/barrel 12 of the gun 10 is placed between the clamping jaws 48 and the jaws brought into contact therewith adjacent the upper edge 50. This will ensure that a clamping force may be generated between the jaws 48 upon the frame/barrel 12 to retain the gun in position upon the device 19.

To releasably force the jaws laterally together to provide a clamping force upon the frame 12, there is provided an operator rod 60 extending through a vertically oriented slot 62 in the jaw 48, the hole 46 in the spacer block 40 and the slot 62 of the other clamping jaw 48, and an appropriate clamping nut 64 is threaded upon rod 60. As may be readily envisioned, rotation of the clamping nut 64 will move the nut along the longitudinal axis of the rod 60 allowing the clamping jaws 48 to be drawn together to clamp the frame 12 therebetween. The rod 60 may include an appropriate blocked end portion 66 adjacent its head, with the blocked portion having a width slightly less than that of the slot 62 such that engagement of the portion 66 within the slot 62 will prevent rotation of the rod with respect to the jaws 48. To provide further convenience, the nut 64 may be provided with appropriate projections 68 to improve manual rotation of the nut, and there may be provided an appropriate washer to ease rotation of the nut when it is in contact with the associated jaw 48.

As may be seen in FIG. 3, the passage of the rod 60 through the vertically elongated slots 62, rather than cylindrical holes, allows the jaws 48 to pivot with respect to the base 20 and rod 60 without binding upon the rod. This pivoting will allow the jaws 48 to take a variety of configurations having varying distances between the upper edges 50, to allow for the receipt of frames/barrels 12 having various widths therebetween. To further reduce the possibility of the rod binding upon the jaws when they are pivoted to a widely spaced condition, the slots 62 may be angled downward towards the laterally central portion of the base 20.

While the above described arrangement will securely clamp the gun 10 to the base 20, it is preferred that there be provided resilient friction material 70 on the interior face of each clamping jaw 48, such that the resilient friction material will be placed in abutment against the frame/barrel 12. The use of a resilient friction material such as rubber, polyurethane, or other similar materials will increase the security of the clamping arrangement due to the increased friction, and will additionally help to attenuate recoil of the gun 10 when fired.

Further means may also be employed to reduce the recoil of the gun. For example, located between the clamp means 36 and the leg 30 there is provided a pad of the resilient friction material 74. The pad is substantially rectangular and elongated in the longitudinal direction, and may be fixed to the base 20 by adhesives. The pad 74 is adapted to act as a rest for the lower face of the butt 16 of the gun, to protect the gun and to aid in reducing recoil, similar to the resilient friction material noted above.

In operation, the operator will rotate the nut 64 to a loosened condition to allow the jaws 48 to be spread well apart. The gun 10 will then be placed above the base 20 with the frame/barrel 12 received within the clamping means 36 and the trigger 14 located to the rear of the clamping jaws. The operator will then rotate the nuts 64 in the opposite direction to draw the jaws 48 together and clamp the frame/barrel 12 securely to the base. In this position the butt 16 of the gun extends well behind the clamping means 36, as shown in FIG. 2, and is readily accessible for a normal position in the hand of the user. The user may then take such a normal firing position, with the trigger 14 fully accessible.

With the user's other hand, or the hand adjacent the trigger 14, resting upon the star wheel 32, the user may view through the sight 18 upon an appropriate target. The star wheel 32 may then be rotated to vary firing angle, and the entire base shifted right or left, until the sight 18 is properly trained upon the target. At this point the user may readily depress the trigger 14 to fire a shot from the gun at the target. During this action the gun is securely retained within the device due to the clamping means, with the majority of the recoil being absorbed by the material 70 and possibly 74, and with the rubber tips upon the legs preventing movement of the base 20. After the shot has been fired the user may then view the hole in the target and make the necessary adjustments to the scope position, with this process being repeated until the scope is in a position to accurately predict the impact of the bullet fired from the gun.

While the method of use described above is suitable for those types of hand guns in which the frame/barrel is rigid adjacent the exit of the barrel, such as revolvers, it is not suitable for use with other types of hand guns, generally designated as moving frame or slide hand guns, such as semiautomatic pistols. In such moving frame or slide hand guns at least a portion of the exterior frame of the hand gun undergoes relative motion with respect to the butt 16 during the firing sequence. For such moving frame or slide hand guns the clamping of the frame between the clamping jaws 48 and placement of the butt 16 upon the recoil attenuating pad 74 will restrict the necessary movement of the frame, preventing the hand gun from firing properly. To allow the device 19 to be employed with such moving frame hand guns, there is provided a frame rest V-block adapter, generally designated by reference numeral 76.

The frame rest 76 is formed as a rigid element elongated in the lateral direction and having a laterally central concave section 78 adapted to receive the frame of the gun adjacent the exit end of the barrel. By forming the portion 78 in a concave or downward tapered manner, the frame will tend to center within the adapter, facilitating placement of the gun. The lateral sides of the adapter 76 include lateral abutment faces 80 which are adapted to be placed in contact with the clamping jaws 48, and in particular the friction material 70. This abutment, aided by the clamping pressure provided by the jaws, will serve to maintain the adapter in place during use. To increase the secure placement of the V-block adapter, there may be provided one or more, and preferably a pair, of positioning pins 82 extending laterally outward from each abutment face. Where this is the case the clamping jaws 48 and covering friction material 70 will be provided with a series of vertically spaced positioning holes 84 sized to receive the pins 82. In this manner the adapter may be more securely retained, and may be placed at a plurality of heights with respect to the base 20, to more readily accept hand guns of various sizes.

To employ the device 19 with a moving frame hand gun, the user will loosen the clamping jaws 48 and place the adapter 76 between the jaws at the desired height, with the pins 82 being received within the holes 84. The clamping jaws will then be tightened by use of the nut 64 to securely retain the V-block adapter in place. The user may then rest the hand gun upon the device with the butt 16 of the hand gun resting upon the friction material pad 74 and the frame of the gun resting upon the concave portion 78 of adapter 76. All remaining steps are similar to those described above, with the only difference being that the frame or slide of the hand gun is not clamped in position by the jaws 48. This will allow greater movement and recoil of the hand gun during Firing, but the support provided by the adapter 76 and pad 74, and the partial recoil absorption by the pad 74, are a definite improvement over standard hand firing.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A hand gun sighting device, for mounting a hand gun, comprising:

a base elongated in the direction of bullet travel and having ends at the extremes of said direction;

clamping means for clamping substantially perpendicular to said direction, said clamping means being mounted to said base adjacent a front end of said base and adapted to engage a frame of the hand gun forward of a trigger of the hand gun;

a pad of resilient material located on said base intermediate said clamping means and a rear end of said base and adapted to support a butt of the gun, said pad being substantially planar without vertical abutment against which a rear of the butt of the gun may abut; and means for adjusting the height of one of said ends of said base with respect to the ground.

2. A device as in claim 7, wherein said clamping means includes a pair of clamping jaws in spaced opposed relation, and a resilient material on inner opposed faces of said jaws.

3. A device as in claim 2, in combination with a frame support adapter, said frame support adapter being mounted in clamped condition between said jaws and extending laterally therebetween, and being adapted to support the frame of the gun.

4. The combination of claim 3, wherein each of said clamping jaws includes at least one mounting hole extending therethrough, and said adapter includes at least one pin extending laterally outward from each lateral side thereof, said pins being received within associated ones of said holes.

5. The combination of claim 4, wherein each of said jaws includes more than one of said mounting holes arranged in spaced vertical relation, whereby said adapter may be placed in various vertical positions relative to said base.

6. The combination of claim 3, wherein said adapter includes a laterally centrally located concave portion adapted to receive at least a portion of the frame of the hand gun.

7. The combination of claim 6, wherein each of said clamping jaws includes at least one mounting hole extending therethrough, and said adapter includes laterally extending pins received within said holes.

8. The combination of claim 7, wherein each of said jaws includes more than one of said mounting holes arranged in spaced vertical relation, whereby said adapter may be placed in various vertical positions relative to said base.

9. A hand gun sighting device, for mounting a hand gun comprising:

a base elongated in the direction of bullet travel and adapted to support a butt of the hand gun;

clamping means for clamping substantially perpendicular to said direction, said clamping means being mounted to said base adjacent a front end of said base, said clamping means including a pair of clamping jaws in spaced opposed relation adapted to engage a frame of the hand gun forward of a trigger of the hand gun;

a frame support adapter, said frame support adapter having a width greater than that of the frame of the hand gun and being mounted in clamped condition between said jaws and extending laterally therebetween, and being adapted to support the frame of the gun, said width of said support adapter resulting in a lack of clamping Upon the frame of the hand gun.

10. For use with a hand gun sighting device, constructed and arranged to mount a hand gun and having a base elongated in the direction of bullet travel and clamping means for clamping substantially perpendicular to said direction and mounted to said base adjacent a front end of said base, said clamping means adapted to engage a frame of the hand gun forward of a trigger of the hand gun, a frame support adapter, comprising:

a laterally elongated body having lateral abutment faces adapted to be contacted by said clamping means whereby said frame support adapter is mounted in clamped condition and extending laterally, and further comprising a laterally centrally located concave portion adapted to receive and support the frame of the hand gun, and at least one pin extending laterally outward from said abutment face, said pins adapted to be received within associated holes in the clamping means of the hand gun sighting device.

* * * * *